US005881868A

United States Patent [19]

Soyak et al.

[11] Patent Number: 5,881,868

[45] Date of Patent: Mar. 16, 1999

[54] CONTAINER FOR LIQUID AND TOBACCO PRODUCT

[76] Inventors: John Soyak, 3955 Ceanothus, Apt. 1; Matthew Bogosian, 5382 Parkmor Rd., both of Calabasas, Calif. 91302

[21] Appl. No.: 957,740

[22] Filed: Oct. 24, 1997

[51] Int. Cl.[6] ..... B65D 85/12

[52] U.S. Cl. ..... 206/213.1; 206/217; 206/256; 206/457; 215/6

[58] Field of Search ..... 206/205, 213.1, 206/217, 236, 242, 256, 457; 215/6; 312/31, 31.1

[56] References Cited

U.S. PATENT DOCUMENTS

| | | | |
|---|---|---|---|
| 59,687 | 11/1866 | Waldstein et al. | 215/6 |
| 393,255 | 11/1888 | Meier | 215/6 |
| 469,001 | 2/1892 | Sherman | 312/31.1 |
| 544,219 | 8/1895 | Godet | 215/6 |
| 1,289,218 | 12/1918 | Maiden | 215/6 |
| 2,187,558 | 1/1940 | Kushima | 215/6 |

*Primary Examiner*—Jim Foster
*Attorney, Agent, or Firm*—Rapkin, Gitlin & Moser; Larry F. Gitlin

[57] ABSTRACT

A liquid container having a vessel integrally formed and recessed within the container for holding cigars of various sizes, and a sealable opening in the container's bottom.

The vessel extends vertically into the chamber from the opening in the bottom of the bottle and includes tapered sidewalls. The diameter at the top end of the vessel is smaller than the vessel's diameter at the bottom at the point of the opening to enable the cigar to be easily extracted from the vessel and, if desired, an unfinished cigar to be reinserted into the vessel. The vessel can be closed and sealed at the bottom to keep the cigar fresh and humidified. A device is inserted into the vessel behind the cigar for use in holding the cigar securely in place when the vessel is closed. To provide humidification, a device comprised of a porous material containing water can be inserted into the vessel along with the cigar.

6 Claims, 3 Drawing Sheets

CONTAINER FOR LIQUID AND TOBACCO PRODUCT

BACKGROUND OF THE INVENTION

1. Field of the Invention

The present invention relates generally to a vessel for containing liquid and, more particularly, to a combination vessel with a receptacle therein for holding a cigar or another type of tobacco product.

2. Background of the Prior Art

Cigar smoking has become increasingly more popular over the past several years, with cigar production and sales escalating at an almost feverish pace. Cigars are enjoyed in a variety of ways, including after a meal, with coffee, and especially with wine, liquor, or an aperitif. Traditionally, liquor and other spirits have often been marketed in their own uniquely packaged containers. Some brands use specially designed containers, typically glass bottles, that may vary in size and shape to enhance product identity by distinguishing one product from another. Examples of these are the Chevas Regal, Crown Royal and Jack Daniels brands.

Cigars, like alcoholic beverages, have always been sold and distributed as an entirely separate product, either as an individual item or in boxes, for example, of 20 or 25 cigars. Individual cigars are often packaged in cellophane wrappers or in metal tubes to keep in their freshness and preserve their quality. The tubes usually bear the name of the cigar brand, including a logo, and some additional interesting and attractive graphics to give the container a more unique appearance. The same applies to cigar boxes and similar types of containers. Nevertheless, though often sold in the same stores, cigars and alcoholic beverage products have never been packaged together as a single entity for mass marketing.

The device of the present invention provides the means to attractively package certain alcoholic beverages and cigar products together in a single container, and the means to store and keep the cigar fresh in a humidified environment within a separate and secure vessel inside the container. The vessel is also structured to ensure and preserve the physical integrity and high quality of the premium cigar inside.

The invention also provides a container with means to store and humidify a partially smoked cigar to maintain its freshness for later use. Given that the cigar is held within a vessel inside a liquor or alcoholic beverage container, a person can now readily enjoy the pleasure of a drink with the cigar of his or her choice. The invention also provides the means to easily extract the cigar from the vessel and return it there for storage within a securely sealed and humidified environment. And finally, the invention provides a device which gives the amusing and illusory appearance of a cigar suspended inside a bottle within the liquid contents.

SUMMARY OF THE INVENTION

The present invention provides for a liquid container having a vessel integrally formed and recessed within the container and a sealable opening in the container's bottom. The container can take many forms, though a stylized liquor or alcoholic beverage bottle, such as the bottle shown in FIG. 1, is typical.

Extending vertically into the chamber from an opening in the bottom of the bottle is a vessel for holding cigars of various sizes. The vessel is integrally formed with the material, usually glass, comprising the liquor or alcoholic beverage container and includes tapered sidewalls. The diameter at the top end of the vessel is smaller than the vessel's diameter at the bottom at the point of the opening. This enables the cigar to be easily extracted from the vessel and, if desired, an unfinished cigar to be reinserted into the vessel.

The vessel can be closed and sealed at the bottom to keep the cigar fresh and humidified. Partially smoked cigars can also be stored within the vessel and maintained fresh for long periods of time.

To prevent the cigar from being jostled around and damaged in transit, a device is inserted into the vessel behind the cigar and used to hold the cigar securely in place when the vessel is closed.

To provide humidification, a device comprised of a porous material containing water can be inserted into the vessel along with the cigar.

Thus, the present invention comprises a unitary device that serves in the dual capacity as a container for a liquid refreshment, such as liquor, and a cigar vessel to both store and maintain the cigar to ensure and preserve its structural integrity in a properly hydrated environment.

Accordingly, it is the object of the present invention to provide an improved container to hold and store both a liquid refreshment and a tobacco product.

Another object of the present invention is to provide an improved container for liquid that also holds and stores a tobacco product in a vessel integrally formed with the liquid container.

A further object of the present invention is to provide an improved container for liquid also having a separate vessel formed within the container that includes the means to facilitate the removal of the cigar from the vessel.

A still further object of the present invention is to provide an improved combination container for a liquid refreshment and tobacco product with means to maintain and preserve the structural integrity, freshness and quality of the tobacco product.

A still further object of the present invention is to provide a combination container for holding a liquid and a tobacco product with the means to reseal and secure the tobacco product within a separate vessel formed inside the container.

A still further object of the present invention is to provide an improved container that is easy and economical to manufacture.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 1:
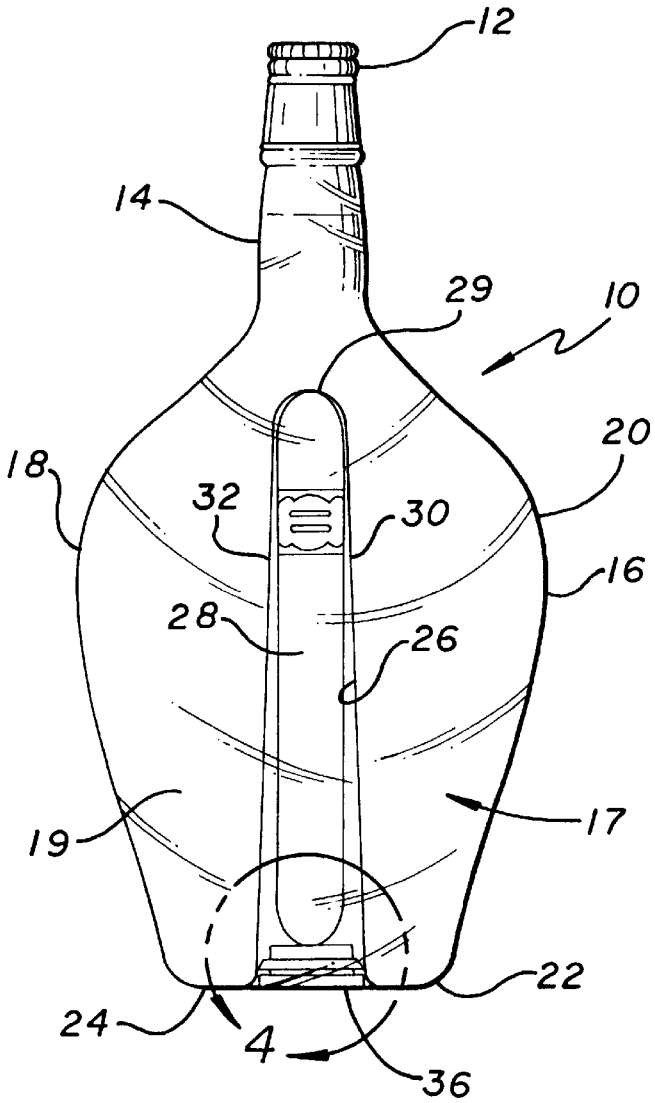
FIG. 1 is a front elevational view of the present invention.
Figure 2:
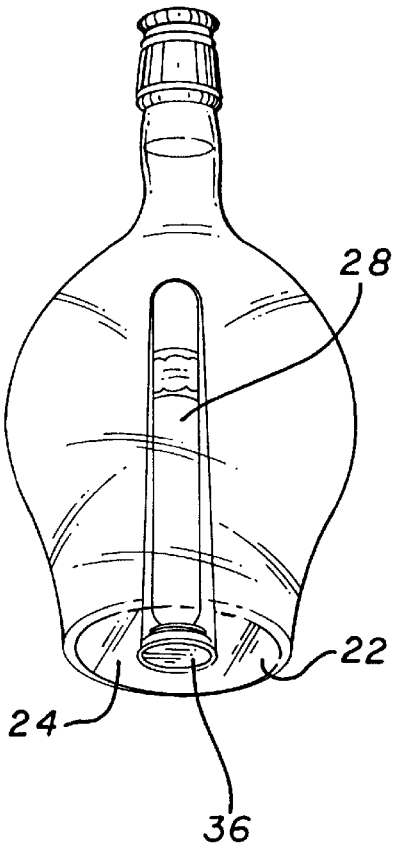
FIG. 2 is a bottom perspective view of the present invention.
Figure 4:
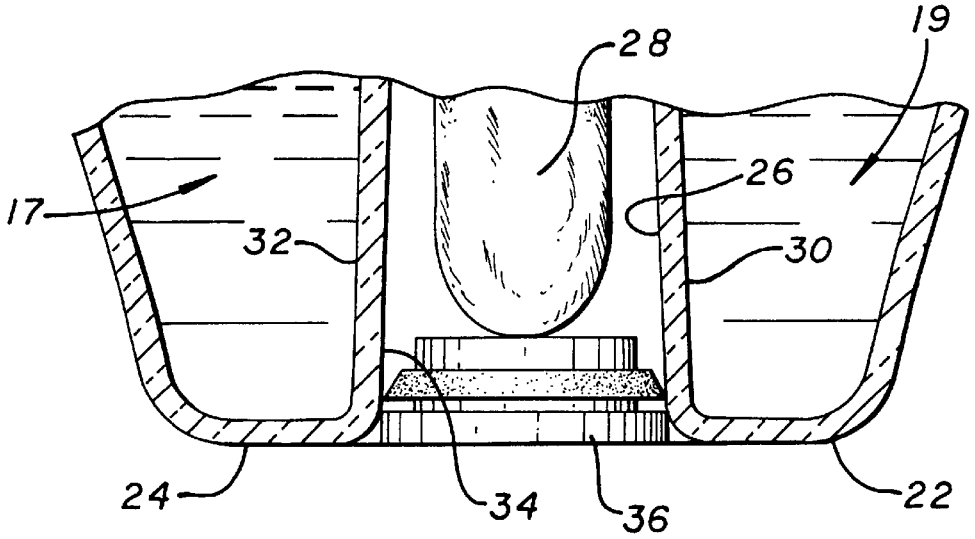
FIG. 4 is an enlarged view of the area shown according to line 4 of FIG. 1.
Figure 3:
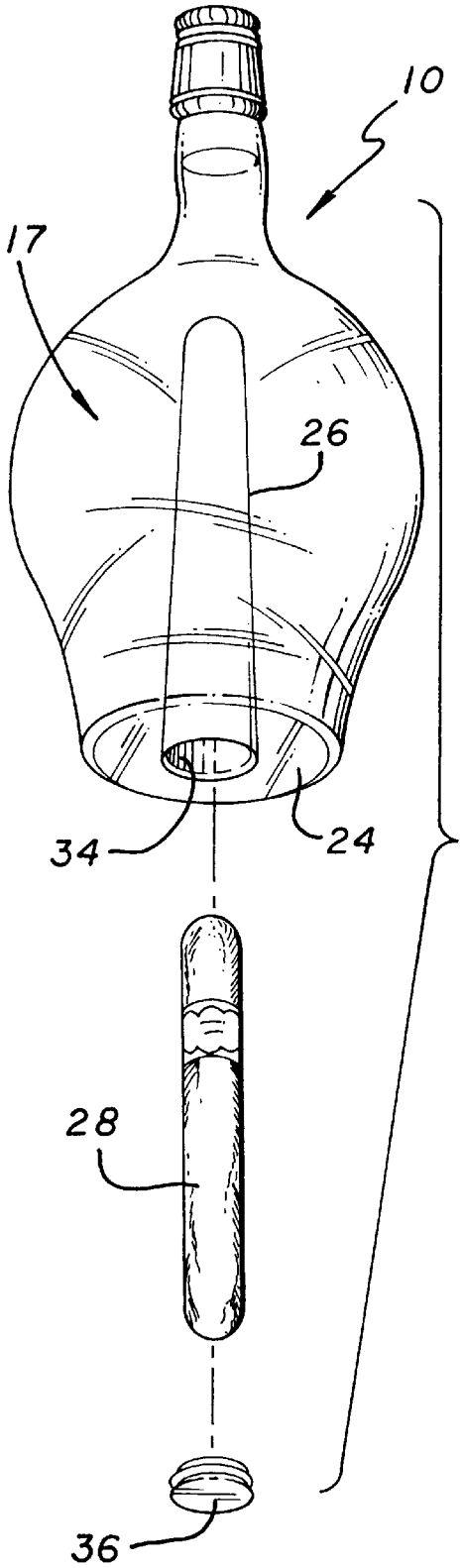
FIG. 3 is a view of the present invention with the tobacco product aligned to be inserted within the vessel.
Figure 5:
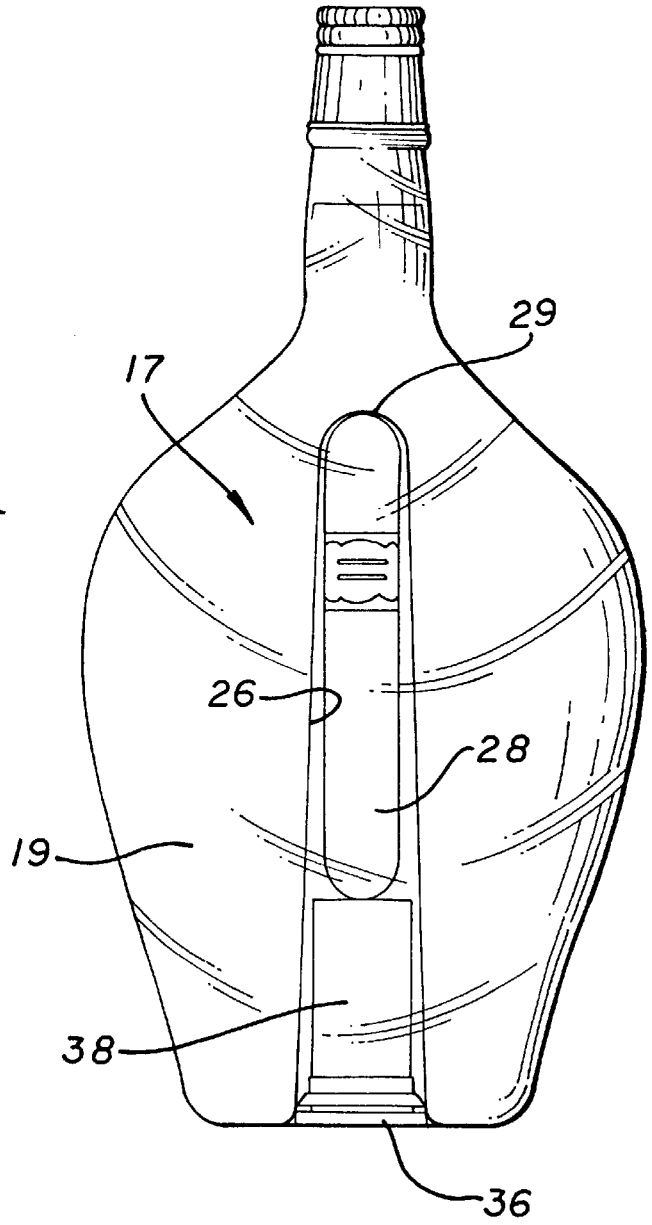
FIG. 5 is a view of the present invention showing the tobacco product sealed inside the vessel.

FIG. 1 shows a liquid or alcoholic beverage container, specifically a liquor bottle 10, having a top 12, neck 14, main body 16, a chamber 17 to hold the liquid contents 19, sidewalls 18, 20 and a base 22 with a bottom 24. Formed integrally with the bottle 10 within the chamber 17 is vessel 26, which holds, stores and displays a tobacco product, such as a cigar 28.

Vessel 26 is defined by a top surface 29, sidewalls 30, 32 and a bottom opening 34. Opening 34 is closed and sealed by cap 36 or any other kind of suitable closure device. A spacer 38 can be inserted after cigar 28 is placed inside the vessel 26 to take up any empty space between the cigar 28 and cap 36 to prevent the cigar from being jostled about and ensure against damage during transit. Cap 36 can be constructed of any suitable material, such as metal, plastic or cork. Any appropriate means to secure the cap to the opening 34 and seal it may be employed, such as mating screw threads.

Spacer 38 can be comprised of any variety of materials, such as plastic or cork, and may be porous to hold water or some other suitable liquid to enable hydration of the vessel to maintain the cigar fresh inside. The level of hydration is predetermined according to the nature of the porous material and the thickness of the cigar or other tobacco product held within the vessel.

Bottle 10 is typically made of glass, as is the vessel 26 within, though plastic or some other suitable materials also may be employed. Bottle 10 may be of any shape or size, and the size of the vessel 26 within may vary according to the dimensions of the cigar or other tobacco product.

Sidewalls 30, 32 are slightly tapered, flaring outward from the top surface 29, which can be arcuate, so that top surface 29 has a width which is slightly narrower than the opening 34. An objective of the present invention is to give the illusory and curious appearance of a cigar suspended within the liquor inside the bottle. There is also the requirement that the cigar 28 be easily removable from the vessel 26 inside and be replaced just as easily. Where the cigar 28 fits tightly within a vessel having parallel sidewalls that abut the entire surface of the cigar, and little air is available within the vessel, a suction usually develops. Thus, it can become difficult to extract the cigar after the cap 36 is removed. Attempts to grab the end of the cigar with the tips of the fingers or some implement in an effort to pull against the suction and remove it could cause the cigar significant damage. To avoid this problem, it is critical that the sidewalls 30, 32 have a slight outward taper, though not so much that the cigar is allowed to easily move about within the vessel, thus destroying the illusion of suspension and subjecting the cigar to possible damage.

Figure 6:
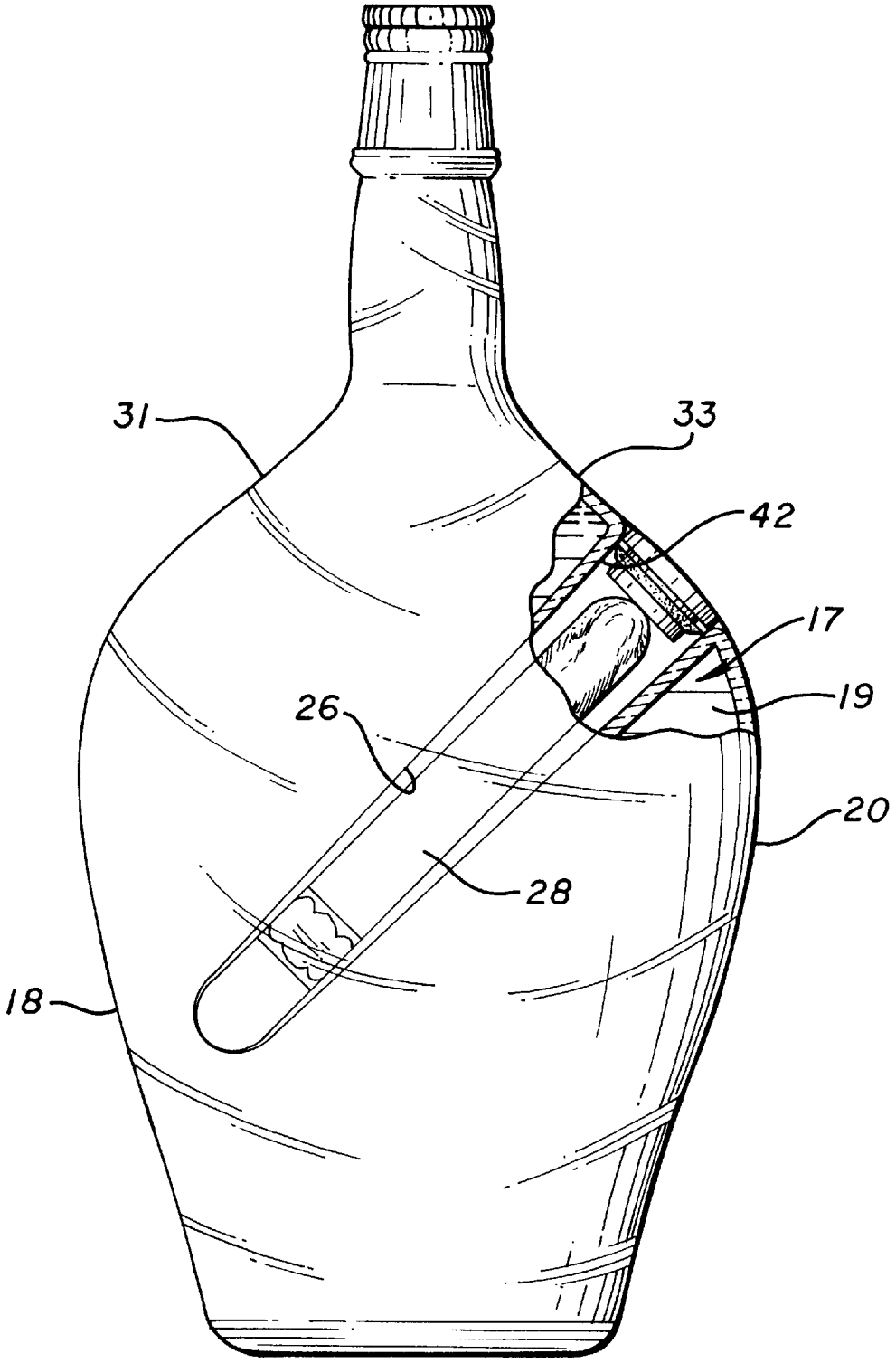
FIG. 6 is an alternative embodiment of the device of the present invention.

An alternative embodiment of the device of the present invention shown in FIG. 6 includes the vessel 26 designed to have its opening formed within either sidewall 18 or 20 of the bottle 10 or within either shoulder 31 or 33 of the sidewalls 18, 20 respectively. FIG. 6 shows one such alternative embodiment of the present invention wherein a cigar 28 is inserted into an opening 42 formed within the shoulder 31 of sidewall 18 and placed inside a vessel 26 located within the chamber 17. The vessel 26 is sealed, as with the device of the preferred embodiment, and the cigar 28 is extracted and reinserted in the same manner.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

We claim:

1. A liquid vessel, comprising:

a container having a transparent main chamber for storing and dispensing liquid, a base section defining an opening therein, a cigar, a receptacle sealed in a vacuum tight manner inside the main chamber and extending vertically from the opening in said base section for receiving and retaining said cigar, said receptacle having transparent walls to give the illusory appearance of the cigar suspended inside the liquid within the main chamber and an upper arcuate end wall in conformal relationship with the end of said cigar with a diameter that is smaller than the diameter of the opening in the base section to facilitate the removal and reinsertion of the cigar within said receptacle after the vacuum seal is broken, and a closure means for sealing said opening in said base section.

2. The invention of claim 1, comprising a means to within said receptacle hydrate the cigar.

3. The invention of claim 1 wherein the means to hydrate said cigar comprises a material saturated with a predetermined amount of water.

4. The invention of claim 3 wherein said material comprises a sponge.

5. The invention of claim 1 having a means to secure said cigar from movement.

6. The invention of claim 5 wherein said means to secure said cigar from movement within said receptacle comprises a cork spacer.

* * * * *